US009468315B2

(12) United States Patent
Ha et al.

(10) Patent No.: US 9,468,315 B2
(45) Date of Patent: Oct. 18, 2016

(54) THEFT DETERRENT DEVICE FOR PRODUCT DISPLAY SYSTEMS

(75) Inventors: John L. Ha, Flushing, NY (US); Anthony C. Squitieri, Monroe, CT (US); Richard J. Fellinger, Franklin Lakes, NJ (US); Keith Arndt, New York, NY (US); Alejandro Reyes-Peniche, Croton-on-Hudson, NY (US)

(73) Assignee: Mechtronics Corporation, Beacon Falls, NY (US)

( * ) Notice: Subject to any disclaimer, the term of this patent is extended or adjusted under 35 U.S.C. 154(b) by 405 days.

(21) Appl. No.: 14/003,054

(22) PCT Filed: Jan. 9, 2012

(86) PCT No.: PCT/US2012/020633

§ 371 (c)(1),
(2), (4) Date: Feb. 7, 2014

(87) PCT Pub. No.: WO2012/094668

PCT Pub. Date: Jul. 12, 2012

(65) Prior Publication Data

US 2014/0173874 A1 Jun. 26, 2014

Related U.S. Application Data

(60) Provisional application No. 61/430,666, filed on Jan. 7, 2011.

(51) Int. Cl.
*A47F 5/08* (2006.01)

(52) U.S. Cl.
CPC ..... *A47F 5/0861* (2013.01); *Y10T 29/49826* (2015.01)

(58) Field of Classification Search
CPC ..... A47F 5/0861; A47F 1/128
USPC ..... 211/7, 59.1; 248/551
See application file for complete search history.

(56) References Cited

U.S. PATENT DOCUMENTS 4,394,909 A * 7/1983 Valiulis ..... A47F 5/0823 211/59.1
5,485,930 A 1/1996 Rushing
(Continued)

FOREIGN PATENT DOCUMENTS

WO 0028512 A1 5/2000

OTHER PUBLICATIONS

International Search Report for International Application No. PCT/US2012/020633, dated Mar. 26, 2012.
(Continued)

*Primary Examiner* — Stanton L Krycinski
(74) *Attorney, Agent, or Firm* — MKG LLC

(57) ABSTRACT

A product display assembly (100) includes a product display device (110) and a security device (160). The display device (110) includes a boom (112) and a peg hook (114). The hook (114) exhibits merchandise along a length of the hook (114). The security device (160) includes a base (118), an arm portion (164) pivotally mounted to the base (118) for rotation, and a foot portion (166) coupled to and extending away from the arm portion (164). In a securing position, movement of merchandise (130) contacts the security device (160). In a retrieval position, the security device (160) is rotated away from the peg hook (114) such that movement of merchandise does not contact the security device (160) and merchandise (130) is removable from the hook (114). In a locking position, the security device (160) rotates away from the hook (114) by continuing contact with the merchandise (130). At a point of the contact, rotation of the security device (160) is inhibited to prevent removal of the merchandise (130) from the display device (110).

8 Claims, 15 Drawing Sheets

(56) References Cited

U.S. PATENT DOCUMENTS

| | | | | |
|---|---|---|---|---|
| 5,711,432 | A * | 1/1998 | Stein | A47F 5/0861 211/57.1 |
| 5,979,674 | A * | 11/1999 | Thalenfeld | A47F 5/0869 211/57.1 |
| 6,269,571 | B1 * | 8/2001 | Thalenfeld | A47F 5/0869 211/57.1 |
| 6,389,722 | B1 * | 5/2002 | Josefsson | A47F 5/0869 211/57.1 |
| 6,604,310 | B1 * | 8/2003 | Lindstrom | A47F 5/0869 40/642.01 |
| 6,957,555 | B1 * | 10/2005 | Nagel | A47F 5/0861 211/57.1 |
| 7,089,695 | B2 * | 8/2006 | Fast | G09F 3/204 40/642.01 |
| 7,197,902 | B1 * | 4/2007 | Barkdoll | A47F 5/0861 211/57.1 |
| 7,392,673 | B2 * | 7/2008 | Fawcett | A47F 5/0861 211/7 |
| 7,530,188 | B2 * | 5/2009 | Beilenhoff | A47F 5/0869 211/57.1 |
| 7,768,399 | B2 * | 8/2010 | Hachmann | A47F 5/0861 340/568.1 |
| 8,499,941 | B2 * | 8/2013 | Barkdoll | A47F 5/0823 211/59.1 |
| 8,534,469 | B2 * | 9/2013 | Northrup, Jr. | A47F 5/0861 211/57.1 |
| 8,629,772 | B2 * | 1/2014 | Valiulis | G08B 13/149 211/57.1 |
| 2007/0119796 | A1 | 5/2007 | Barkdoll | |
| 2009/0095695 | A1 | 4/2009 | Moock et al. | |
| 2014/0197953 | A1 * | 7/2014 | Valiulis | G08B 13/149 340/568.8 |
| 2015/0216325 | A1 * | 8/2015 | Pongrac | A47F 5/0861 211/59.3 |

OTHER PUBLICATIONS

International Preliminary Report on Patentability for International Application No. PCT/US2012-020633, dated Jul. 18, 2013.

Extended European Search Report for EP12732370.7-1653/2678500, PCT/US2012020633, dated Mar. 2, 2015.

* cited by examiner

THEFT DETERRENT DEVICE FOR PRODUCT DISPLAY SYSTEMS

BACKGROUND OF THE INVENTION

1. Field of the Invention

This invention relates to merchandise and/or product display systems and, in particular, to a theft deterrent system for merchandise and/or product display systems having a security device that prevents unauthorized removal of merchandise exhibited on merchandise hooks.

2. Related Art

In some retail establishments, merchandise is typically exhibited on rods or hooks extending from a wall, pegboard, slatboard, rack, shelf or other display device. Such display devices typically allow a prospective customer to remove and examine merchandise prior to purchasing them. These rods are commonly referred to in the art as pegboard or slatboard hooks.

Items of merchandise such as, for example, razors, batteries, small tools, tool components, film, cameras, portable electronic equipment, mobile telephones, watches, jewelry or other relatively expensive consumer products that are displayed in areas where consumers may pick up the items and examine them prior to purchase. Unfortunately, merchandise displayed in such a manner is an easy target for theft by shoplifters. Merchandisers have found that shoplifters can rapidly empty all of the merchandise from a pegboard display hook (referred to in the art as a "sweeping action") and make off with the merchandise without being detected.

Accordingly, it is desired in the art to provide a theft deterrent system for these types of display devices so that large quantities of merchandise cannot be rapidly removed. Such a theft deterrent system would allow legitimate consumers to remove one or more merchandise items at a controlled pace to prevent or at least substantially minimize potential theft such as by the aforementioned sweep actions.

SUMMARY OF THE INVENTION

In one aspect, there is disclosed a security device mounted to a product display device having a boom member and a peg hook for exhibiting merchandise, the security device comprising: a base for mounting the security device to the boom member at a position spaced vertically above the peg hook; an arm portion pivotally mounted to the base for rotation about an axis; and a foot portion coupled to and extending away from the arm portion; the security device being disposed in one of a plurality of positions including: a securing position, where at least a portion of the security device is disposed in front of the peg hook and if the merchandise moves along a length of the peg hook at least a portion of the merchandise contacts the at least portion of the security device; a retrieval position, where the security device is first rotated away from the peg hook and out of the securing position such that when merchandise moves along the length of the peg hook the merchandise is removable from the peg hook without contacting the security device; and a locking position, where the security device is initially in the securing position and then at least partially rotates away from the peg hook by contact with the merchandise at a predetermined point of contact, the security device inhibits withdrawal of the merchandise from the peg hook.

In another aspect, there is disclosed a method for inhibiting removal of merchandise from a product display device, the method comprising: positioning merchandise on a product display device, the product display device including a boom member, a peg hook for exhibiting the merchandise, and a securing end to secure the product display device to a support surface; mounting a security device to the boom member, the security device including a base, an arm portion pivotally mounted to the base for rotation about an axis and a foot portion coupled to and extending away from the arm portion; placing the security device in front of the peg hook such that when the merchandise moves along a length of the peg hook at least a portion of the merchandise contacts the security device; and rotating the security device away from the peg hook while continuing contact between at least a portion of the merchandise and the security device, and at a predetermined point of the contact, further rotation of the security device is inhibited to prevent removal of the merchandise from the product display device.

The foregoing aspects, as well as others, are illustrated and discussed in more detail in the following drawings and description.

DETAILED DESCRIPTION OF PREFERRED EMBODIMENTS

Figure 1A:
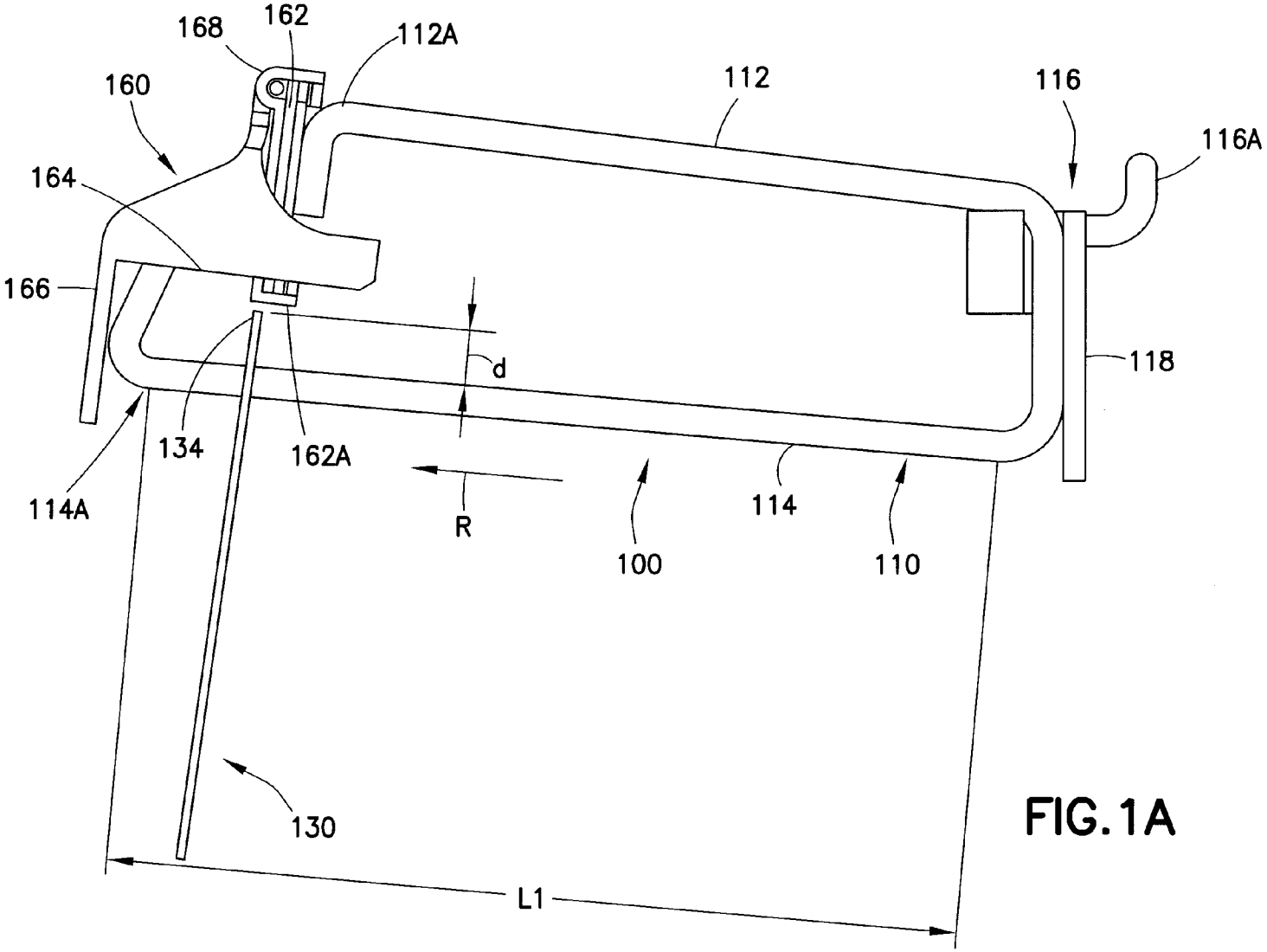
FIG. 1A is a side view of a security device affixed to a product display assembly according to one embodiment of the present invention.
Figure 1C:
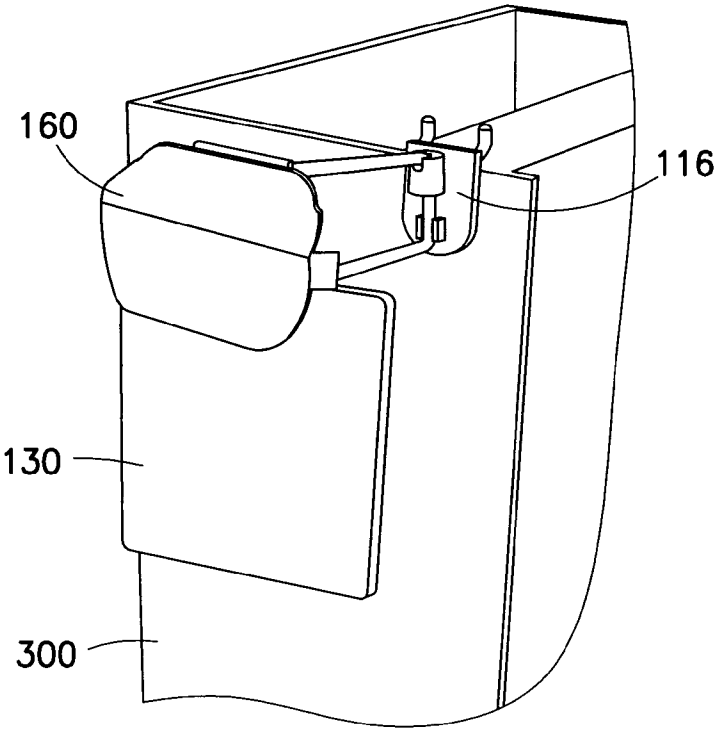
FIG. 1C illustrates the security device and the product display device mounted and in use on a display surface.
Figure 1B:
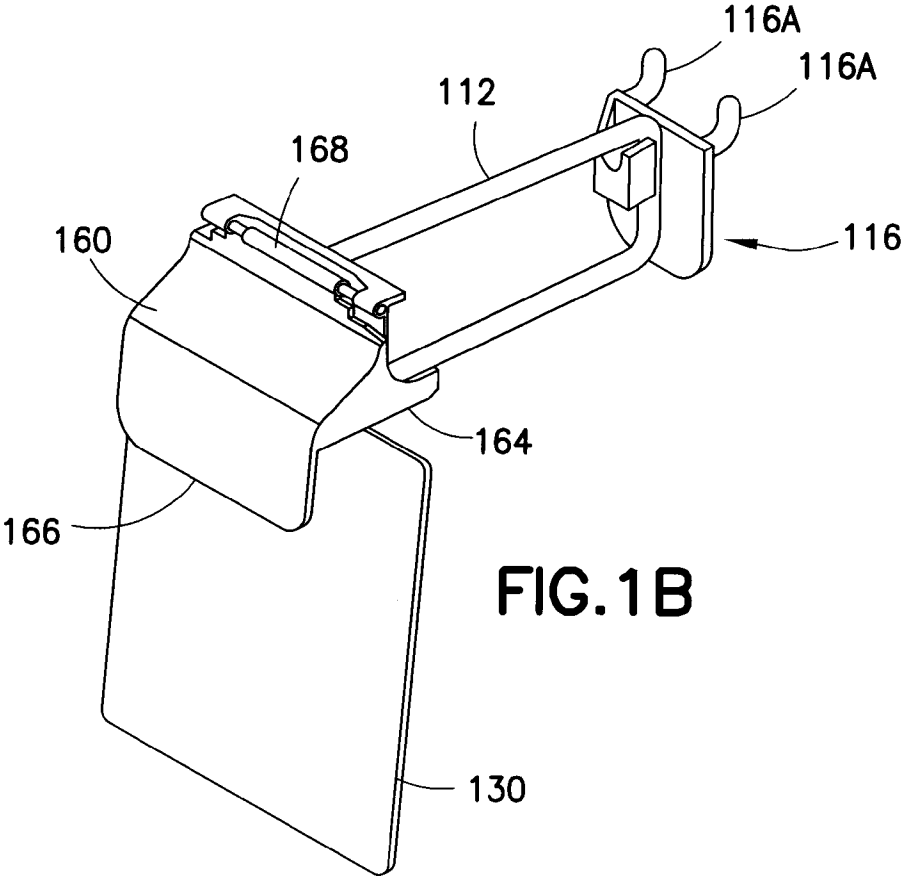
FIG. 1B is a perspective view of the security device and the product display device of FIG. 1A.

FIGS. 1A to 1D, 2A to 2C, 3A to 3C, 4A to 4C, and 5A to 5C depict several views illustrating features of the invention. In the following discussion, the reference to FIG. 1, for example, is referring to all three views of FIG. 1 including: FIG. 1A, a side view; FIG. 1B, a perspective view; FIG. 1C, a view showing a security device of the present invention disposed on a product display assembly; and FIG. 1D, a side view. It should be appreciated that FIGS. 2-5 are similarly referenced such that the features described are shown on all three views of the figure being referred to. Reference numbers may be noted on only one of the figures but the references are generally applicable to all of the figures without the need to repeat the reference number in each figure.

FIG. 1 shows a security device 160 disposed on a product display assembly 100 according to one embodiment of the present invention. The product display assembly 100 includes a product display device 110 such as, for example, a pegboard display device, with the security device 160 coupled thereto. As described herein, the product display device 110 and the security device 160 cooperate to control a pace of withdrawal or removal of one or more items of merchandise 130 from the product display assembly 100. In one embodiment, the product display device 110 includes a boom member 112, a peg hook 114 for exhibiting merchandise 130 thereon and a securing end 116 for securing the product display device 110 to a merchandise display and support surface such as a product pegboard. For example, as shown in FIGS. 1A and 1B, the securing end 116 includes one or more hooks 116A that engage perforations in a pegboard, as is generally known in the art. Alternatively, as shown in FIG. 1C, the securing end 116 of the product display device 110 is affixed directly to the display and support surface such as a display cabinet, shelf, rack or other display device 300 by, for example, clamps, fasteners or the like.

Figure 12A:
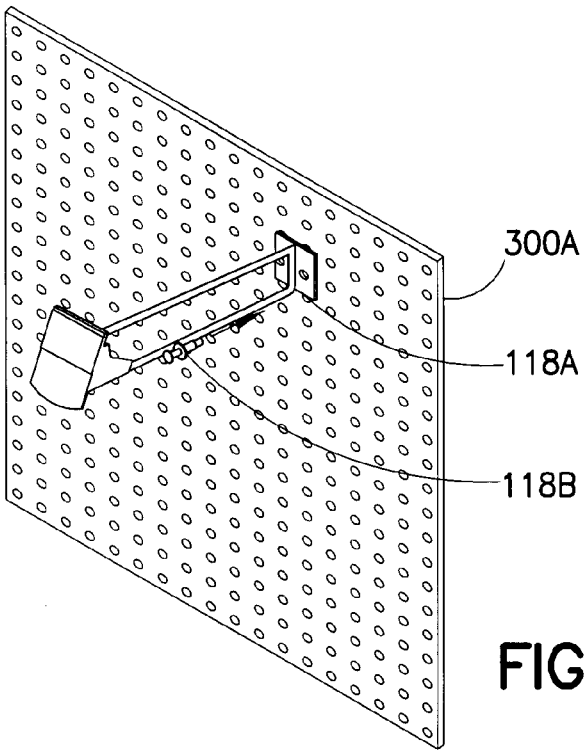
FIGS. 12A-12C illustrate secure mounting of the security device and the product display device to one or more display surfaces in accordance with one or more embodiments of the present invention.
Figure 12B:
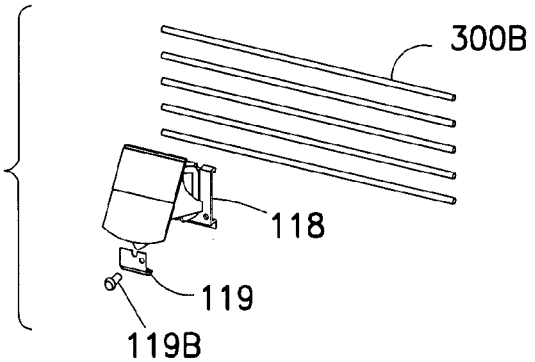
Figure 12C:
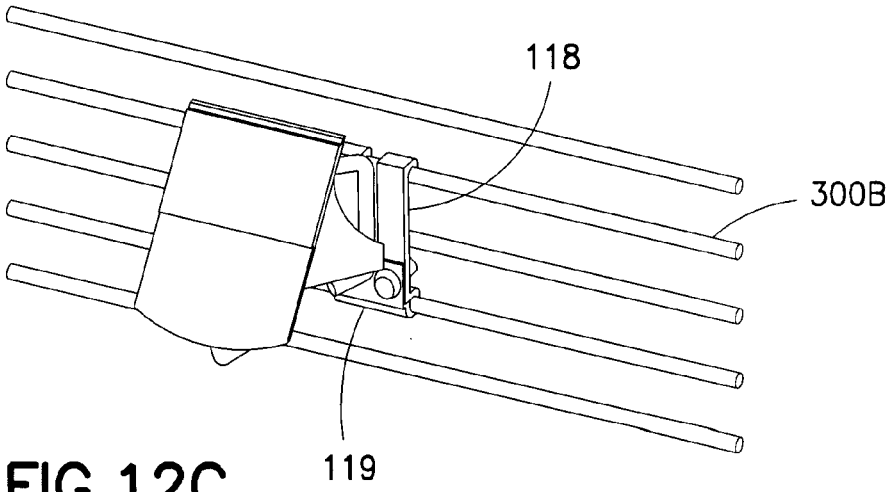

As shown in FIG. 1, the boom member 112 and the peg hook 114 extend forwardly from the securing end 116. In one embodiment, the boom member 112 and the peg hook 114 extend forwardly from a base plate 118 and the one or more hooks 116A of the securing end 116 extend rearwardly from the base plate 118. One or more items of merchandise 130 are disposed on and hang downwardly from the peg hook 114 in a generally forward to rearward column. As can be appreciated, each item of merchandise or its packaging includes an aperture, hook or the like, that accepts the peg hook 114. As illustrated in FIGS. 12A-12C in one embodiment the base plate 118 includes an aperture 118A that receives a fastener 118B such as, for example, a screw, bolt or rivet, to securely affix the base plate 118 and thus the product display device 110 to the display surface 300 (illustrated in FIG. 12A as a peg board display device 300A). In one embodiment, illustrated in FIGS. 12B and 12C, a locking plate 119 receives a fastener 119A such as, for example, a screw, bolt or rivet, to securely affix the base plate 118 and thus the product display device 110 to the display surface 300 (illustrated in FIGS. 12B and 12C as a grid wall display device 300B).

As shown in FIGS. 1 and 2, to examine the merchandise 130 hanging on the peg hook 114, a prospective consumer 200 moves the merchandise 130 forwardly along at least a portion of a length L1 of the peg hook 114 in a direction indicated by arrow R and R1 until the merchandise 130 passes beyond the peg hook 114. Optionally, as shown in FIG. 3, the peg hook 114 includes a ball or an upturned end 114A disposed forwardly from the securing end 116 such that, for retrieval and examination, the merchandise 130 must traverse the length L1 of the peg hook 114 in the direction indicated by arrow R1 and be vertically lifted over the upturned end 114A by a prospective consumer moving the merchandise 130 in a direction indicated by arrow R2. This type of peg hook 114 with the upturned end 114A is typically referred to as a J-hook.

As shown in FIG. 5, in one embodiment, a peg hook 214 may also include a raised portion 214B disposed along a portion of its length L2. The peg hook 214 is otherwise substantially compatible in feature and function with peg hook 114 and the peg hooks 114 and 214 may be used interchangeably. As a column of merchandise 130 is moved along at least a portion of length L2, one or more items within rearward portions of the column must be lifted over the raised portion 214B by the prospective consumer in a direction indicated by arrow R3 to retrieve the merchandise from the peg hook 214. As such the raised portion 214B may slow the pace of removal.

Figure 3A:
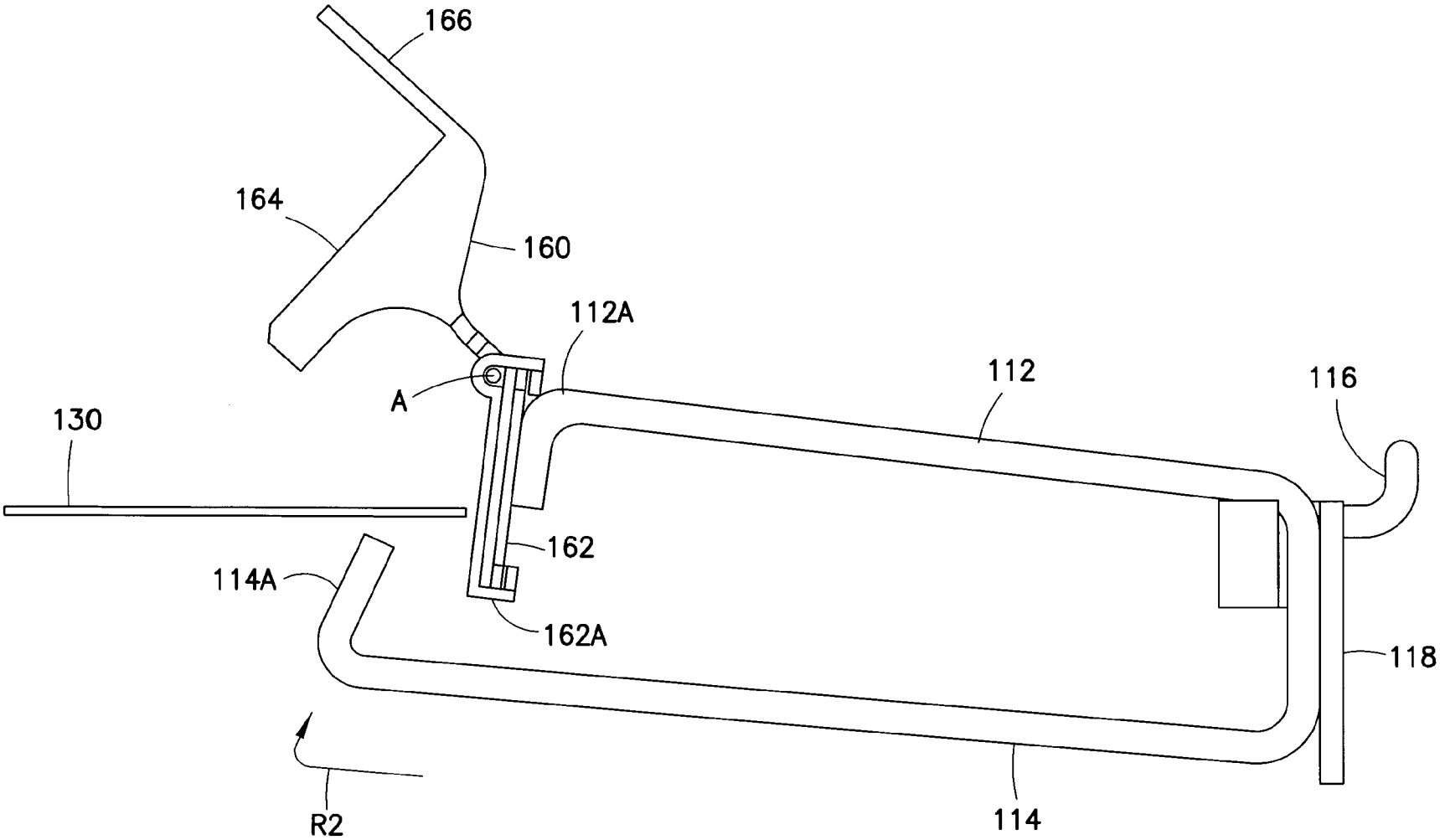
FIG. 3A is a side view of the security device and the product display device of FIG. 2A showing the security device positioned for releasing the product from a peg according to an embodiment of the invention.

In one aspect of the present invention, the security device 160 is mounted to a forward or distal end 112A of the boom member 112. The forward end 112A is in a direction opposite the securing end 116 and the base plate 118 attached thereto. As illustrated in FIGS. 1A and 3A, the security device 160 is mounted to the boom member 112 at a base 162. In one embodiment, the base 162 is spaced vertically above the peg hook 114 by a distance "d" sufficient to allow the merchandise 130 to freely traverse the length L1 of the peg hook 114 under a lower portion 162A of the base 162 of the security device 160 toward the upturned end 114A of the peg hook 114.

Figure 1D:
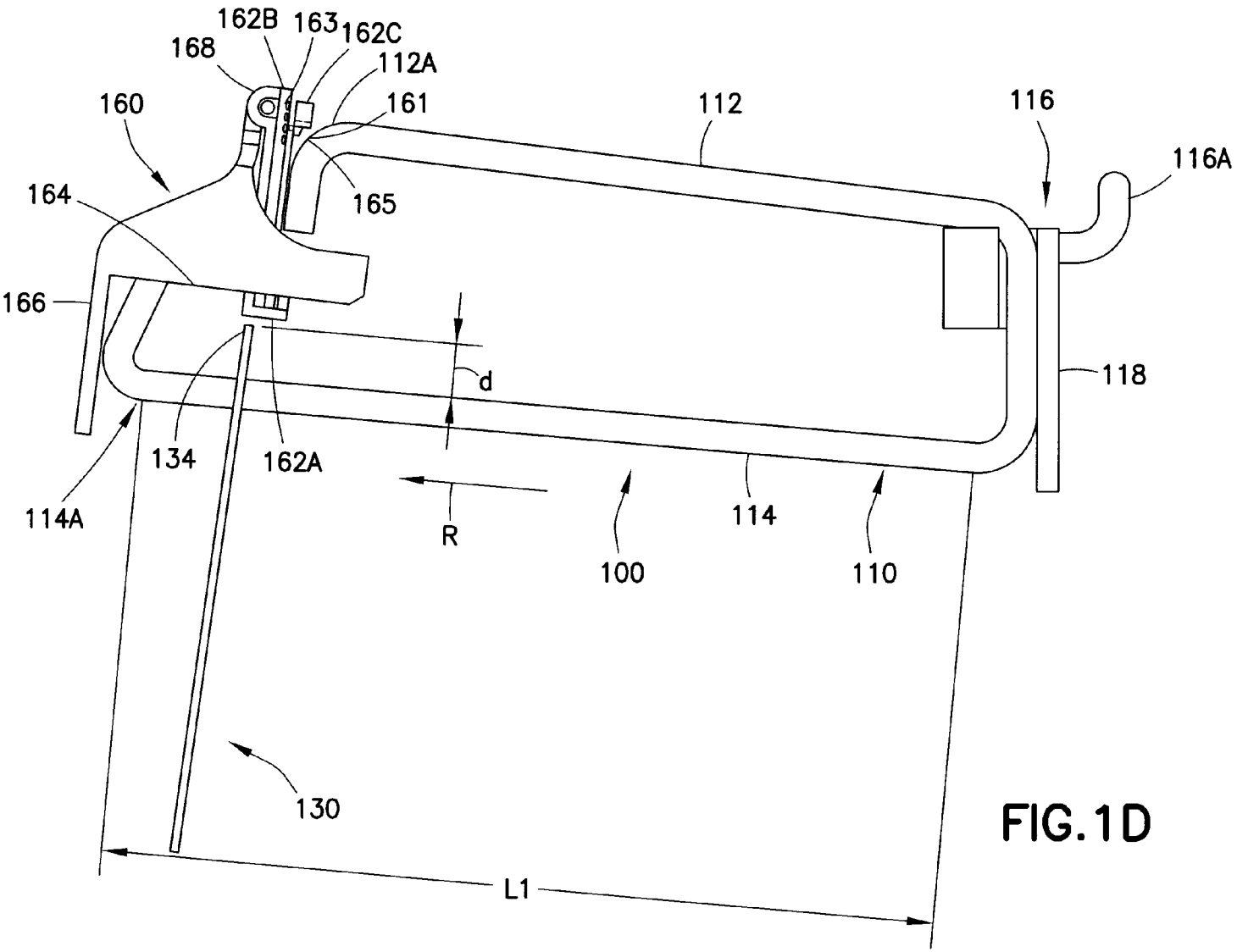
FIG. 1D illustrates a side view of a security device affixed to the product display device according to one embodiment of the present invention.

In one embodiment, as shown in FIG. 1D, the base 162 is comprised of two or more component parts, for example, a first part 162B and a second part 162C, which allows a user, e.g., store personnel, to adjust the distance d between the lower portion 162A of the base 162 and the peg hook 114 to allow differently sized merchandise 130 to be placed on the peg hook 114 and pass under the lower portion 162A of the base 162 without contact. In one embodiment, the first part 162B of the base 162 includes at least one aperture 163 for mounting the first portion onto the second part 162C. The second part 162C of the base 162 is mounted to the forward end 112A of the boom member 112. The second part 162C of the base 162 has at least one thread hole 165 to receive fasteners 161, such as a screw or a bolt, for mounting the first portion 162B of the base 162 onto the second portion 162B through the apertures 163. Depending on the desired distance d between the peg hook 114 and the lower portion 162A of the base 160, a user can vertically lower or raise the base 162 in relation to the peg hook 114 by using the apertures 163 and at least one thread hole 165 present on the first and second portion 162B, 162C of the base 162. In one embodiment, the first part 162B includes one slotted aperture to permit vertical adjustment of the first part 162B relative to the peg hook 114.

As shown in FIGS. 1-4, the base 162 of the security device 160 is mounted to the boom member 112, and an arm portion 164 of the security device 160 is pivotally mounted to the base 162 by, for example, a hinge 168 or like mechanism for rotation about an axis A, and a foot portion 166 of the security device 160 is coupled to and extends away from the arm portion 164 (FIG. 3A). In one embodiment, the foot portion 166 of the security device 160 extends perpendicularly away from the arm portion 164 at about a ninety degree (90°) angle. In one embodiment, the arm portion 164 and the foot portion 166 are integrally formed in a one-piece construction. It should be appreciated that the form (e.g., shape), size and/or angular relation of the security device 160 and/or one or more components thereof, may be varied but otherwise still cooperate to perform the security features and functions as described herein to control the pace of withdrawal and/or removal of items of merchandise exhibited on the product display assembly 100.

As illustrated in FIG. 5, a security device 260 includes a placard or label holder, shown generally at 280. The placard 280 is attached or mounted onto the security device 260 to exhibit product information such as, for example, price, operating instructions, a graphic, brand or product or corporate trademark, or other information regarding the merchandise 130 and/or the source thereof. It should be appreciated that the security device 260 is substantially compatible in features and functions as the security device 160 including, for example, a base 262 of the security device 260 for mounting the security device 260 to the boom member 112, an arm portion 264 that is pivotally mounted to the base 262 by, for example, a hinge 268 or like mechanism for rotation about an axis A', and a foot portion 266 that is coupled to and extends away from the arm portion 264.

Figure 5A:
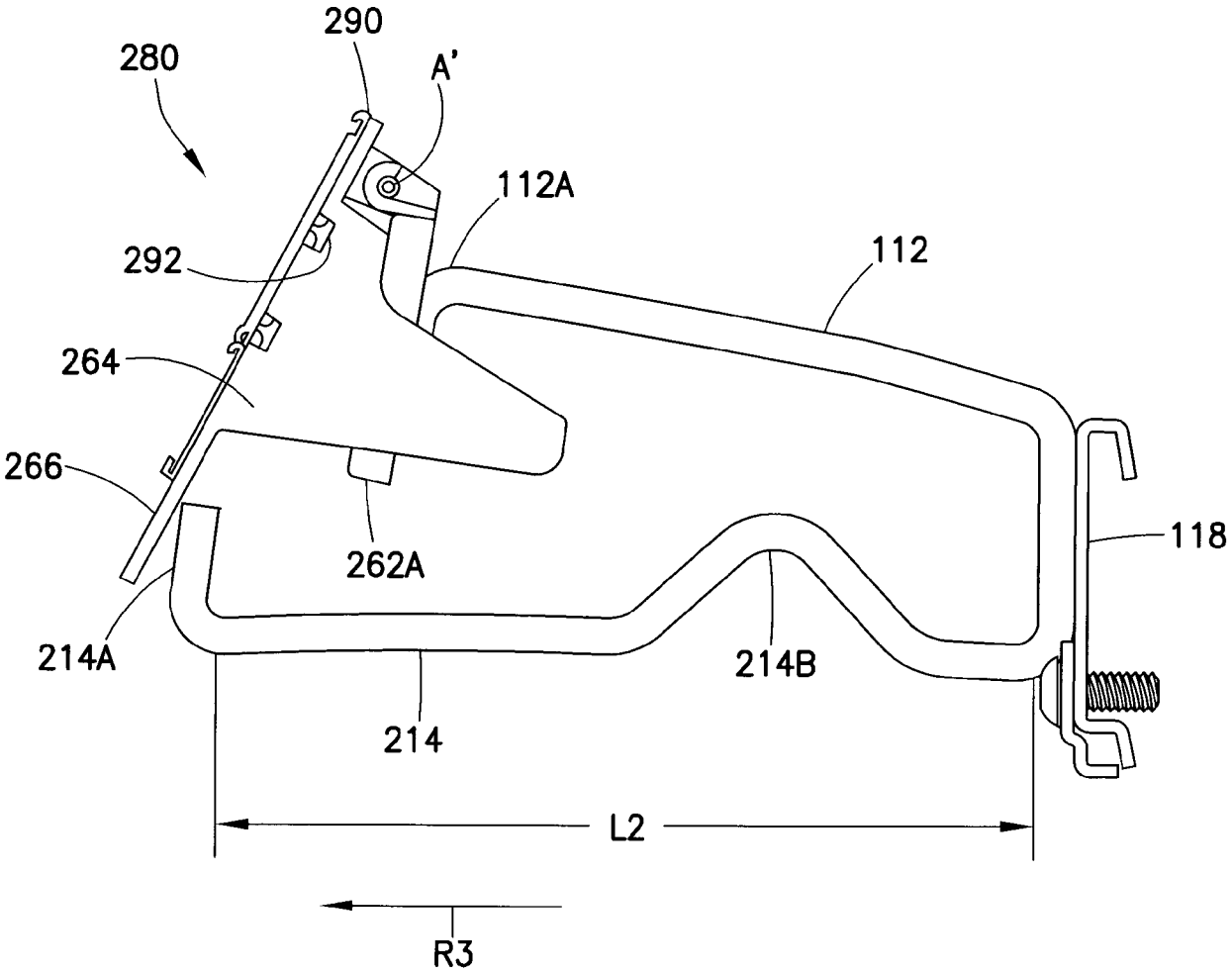
FIG. 5A is a side view of a security device and a product display device in a first position, according to one embodiment of the present invention.

As shown in FIG. 5A, the placard 280 includes a plurality of exhibition areas 282 such as, for example, a price area 284 and a header area 286 for exhibiting product information. It is contemplated that the placard 280 may include only one of the aforementioned exhibition areas 282, for example, one of the price area 284 or the header area 286. In one embodiment, the placard 280 may include a clear plate or cover 288 that is selectively affixed over one or more of the plurality of exhibition areas 282.

Figure 5B:
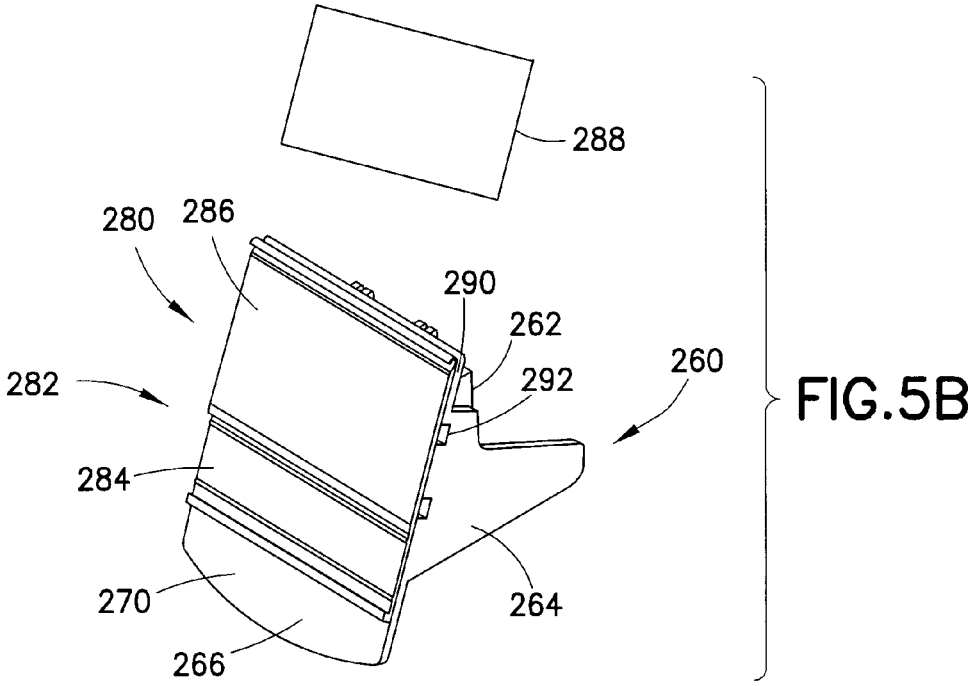
FIG. 5B is a perspective view of a placard attached to the security device of FIG. 5A.
Figure 5C:
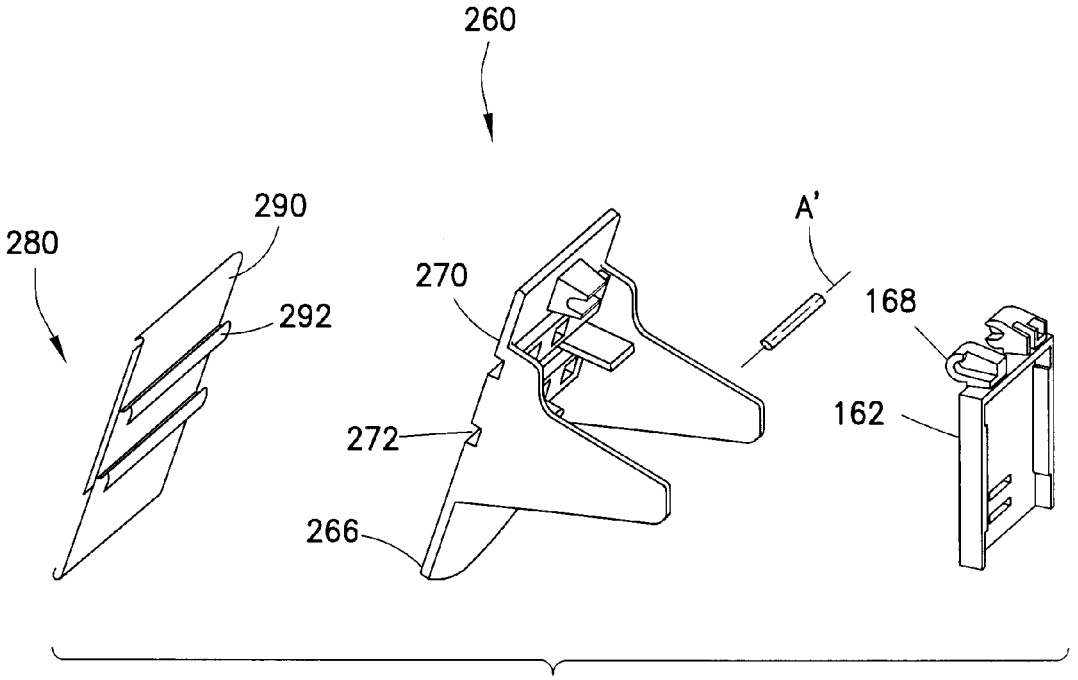
FIG. 5C is an exploded perspective view of the security device and the placard of FIG. 5B.

As shown in FIGS. 5, 5A and 5B, the placard 280 is attached to the security device 260 by engaging one or more lugs 292 that extend from a rear surface 290 of the placard 280. The lugs 292 are received in one or more corresponding channels 272 formed in a surface 270 of the security device 260. In one embodiment, the surface 270 is an upper portion of the foot portion 266 of the security device 260. However, other modes of attachment such as adhesives and the like, and placement of the surface 270, are contemplated depending on the structure and shape of the security device 260. Moreover, it is contemplated that the security device 260 and the placard 280 may be formed as an integrated (e.g., one-piece) unit.

Referring now to FIGS. 1-5, the security devices 160 and 260 are capable of being used in one of three positions including, for example, a securing position, a retrieval position and a locking position. In the securing position, as shown in FIGS. 1 and 5, the foot portions 166 and 266 is disposed in proximity to, e.g., in front of, the peg hooks 114 and 214 such that merchandise 130 cannot be removed from the peg hooks 114 and 214 without encountering the security devices 160 and 260. In the securing position, the foot portions 166 and 266 of the respective security devices 160 and 260 are in proximity to the upturned end 114A and 214A of the peg hooks 114 and 214 such that the merchandise 130 cannot be removed without encountering one or both of the arm portions 164 and 264 and the foot portions 166 and 266.

As shown in FIGS. 2 and 3, in the retrieval position, the security device 160 is selectively rotated by a prospective consumer 200 in the direction indicated by arrow P about axis A so that the arm portion 164 and the foot portion 166 of the security device 160 are disposed away from the peg hook 114 and the merchandise 130 may be removed from the peg hook 114 by, for example, lifting the merchandise 130 over the upturned portion 114A in the direction indicated by arrow R2. It should be appreciated that the security device 260 operates in a similar fashion. It should also be appreciated that retrieval of the merchandise 130 includes a multi-step process wherein the consumer 200 first selectively actuates the security device 160 by rotating the device 160 about the axis A in the direction indicated by arrow P, as the consumer 200 next slides the merchandise 130 along at least a portion of the length L1 of the peg hook 114 in the direction indicated by arrow R1 until the merchandise reaches and is lifted over the unturned portion 114A in the direction indicated by arrow R2.

Figure 2A:
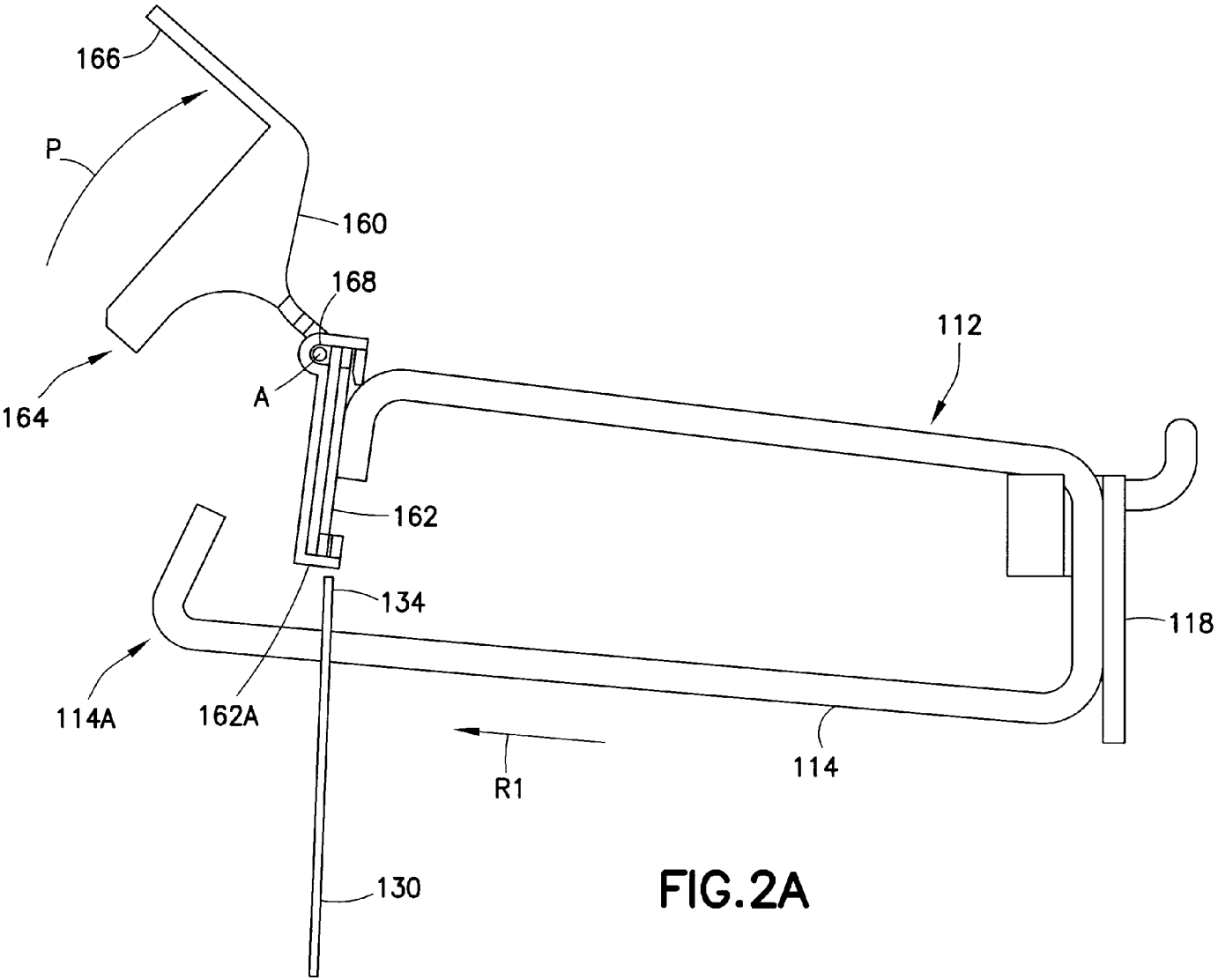
FIG. 2A is a side view of the security device and the product display device of FIG. 1A in a second position, according to a particular aspect of the invention.
Figure 2C:
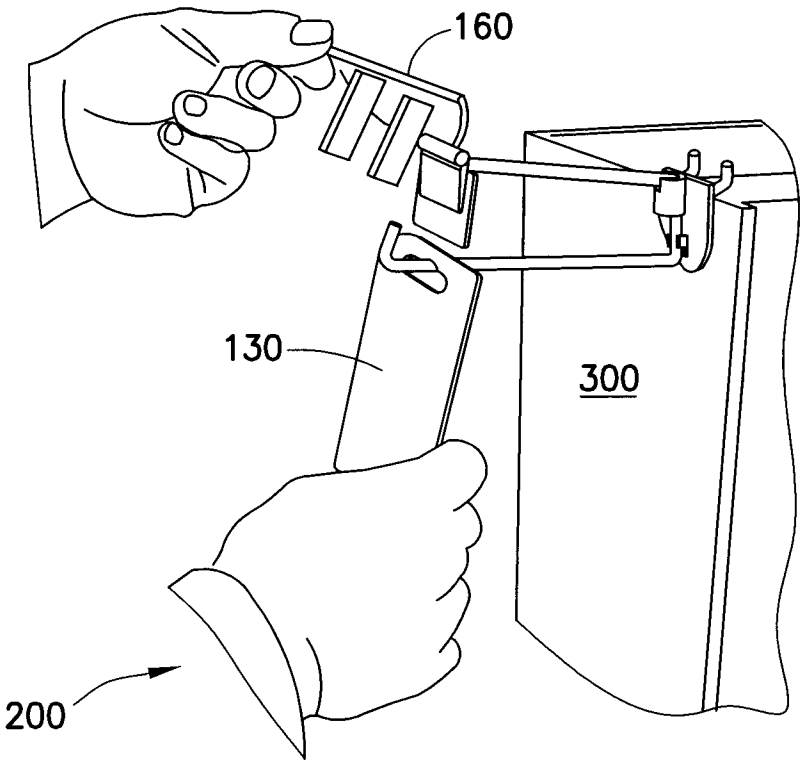
FIG. 2C illustrates the security device and the product display device mounted on a display surface and disposed in the second position of use by a customer to release merchandise from the display device.
Figure 3C:
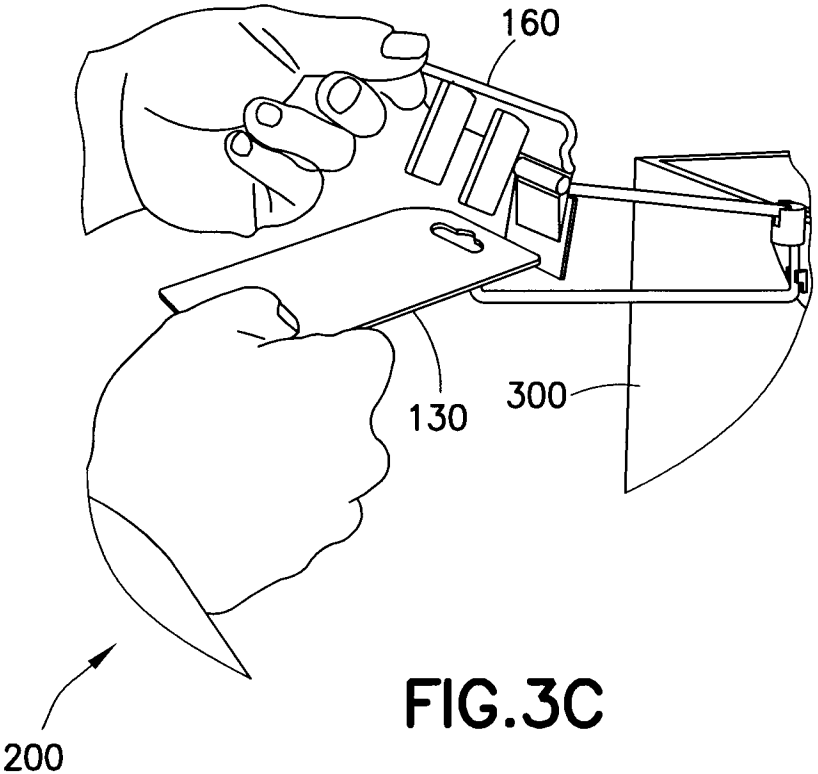
FIG. 3C illustrates the security device and the product display device mounted on the display shelf in use by a customer and properly positioned for releasing a product from the display device.
Figure 3B:
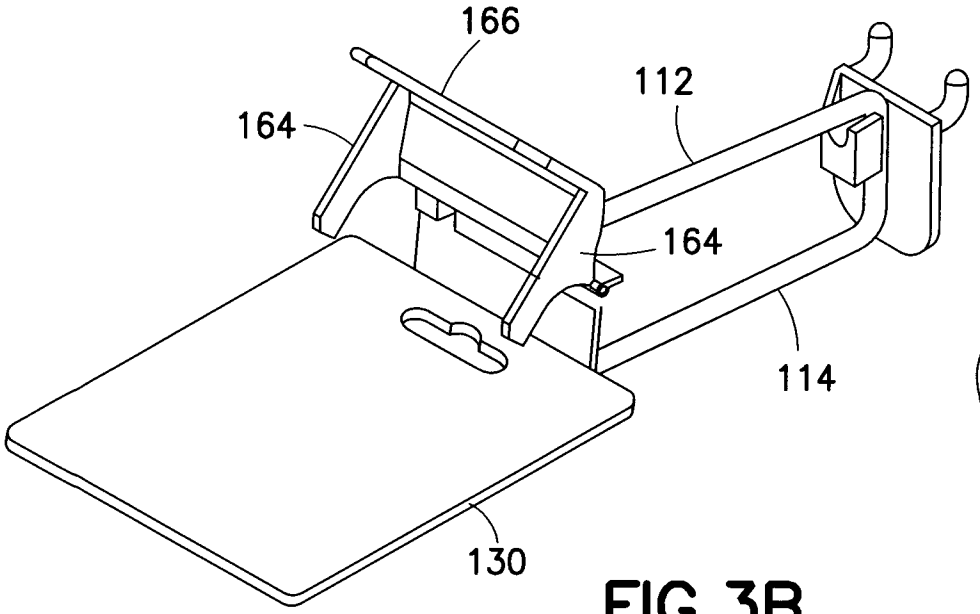
FIG. 3B is a perspective view of the security device and the product display device of FIG. 3A.

As shown in FIGS. 2C and 3C, the multi-step process typically includes two handed operation by the consumer 200, for example, one hand operating the security device 160 and one hand retrieving the merchandise 130, to remove the merchandise 130 from the product display assembly 100. It should be appreciated that this multi-step process controls a pace of removal to substantially minimize, if not eliminate, an ability to sweep a number of items of merchandise 130 from the peg hook 114 for possible theft. As noted above, the security device 260 operates in a similar fashion.

Figure 2B:
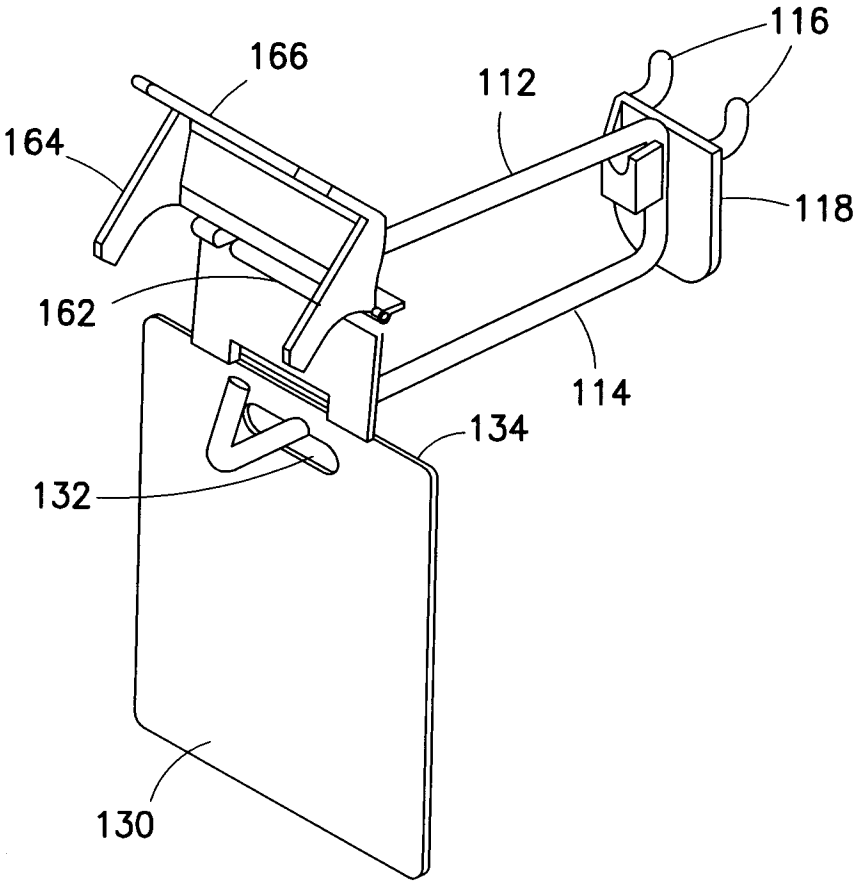
FIG. 2B is a perspective view of the security device and the product display device of FIG. 2A, according to a particular aspect of the invention.

As discussed above, FIGS. 1-3 and 5 illustrate exemplary functions of the security devices 160 and 260 and their ability to display merchandise and allow retrieval of merchandise while minimizing sweep actions. As shown in FIGS. 1-3, the merchandise 130 and/or merchandise packaging is positioned by stocking personnel on the product display assembly 110 by threading the peg hook 114 through a mounting hole 132 (best illustrated in FIG. 2B) on or in the merchandise or the merchandise packaging so that as the merchandise is moved toward the upturned end 114A of the peg hook 114. In FIGS. 2 and 3, the merchandise 130 is pulled by the customer 200 toward the upturned end 114A and as the merchandise approaches the upturned end 114A, the customer 200 actuates the security device 160 by rotating the security device 160 about the axis A in the direction of arrow P so that a top edge 134 of the merchandise 130 or merchandise packaging passes under and clears the security device 160 and the merchandise 130 is retrieved from the peg hook 114.

FIG. 4 illustrates exemplary function of the security device 160 when the aforementioned multi-step retrieval process is not performed successfully and thus, retrieval of merchandise 130 is inhibited. As shown in FIG. 4, in the locking position, the security device 160 is partially rotated by the merchandise 130 as it is moved by the consumer 200 over the upturned portion 114A. Since the security device 160 is not actuated or rotated in advance, portions of the security device 160 encounter or contact at least a portion of the merchandise 130 and/or its packaging, as noted above with reference to the securing position. While contact continues between the security device 160 and the merchandise 130, the security device 160 continues to rotate about the axis A.

Figure 4A:
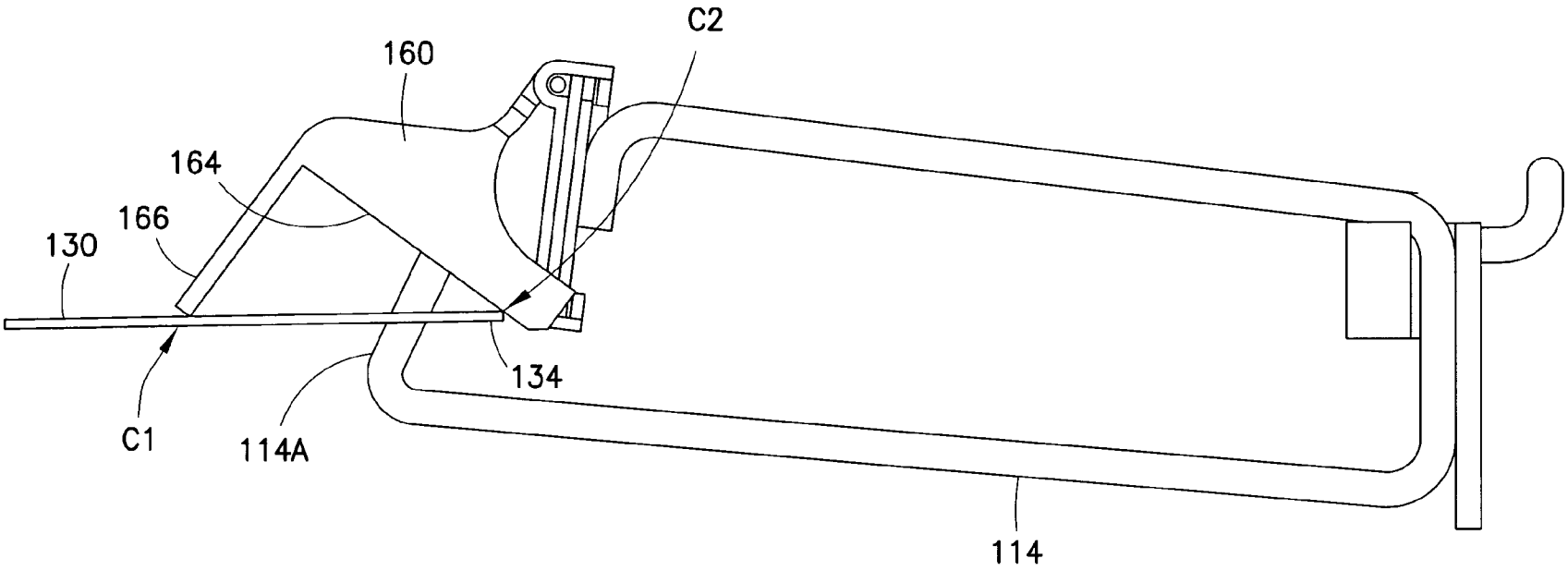
FIG. 4A is a side view of the security device and the product display device of FIG. 1A in a third position, according to an embodiment of the invention.
Figure 4B:
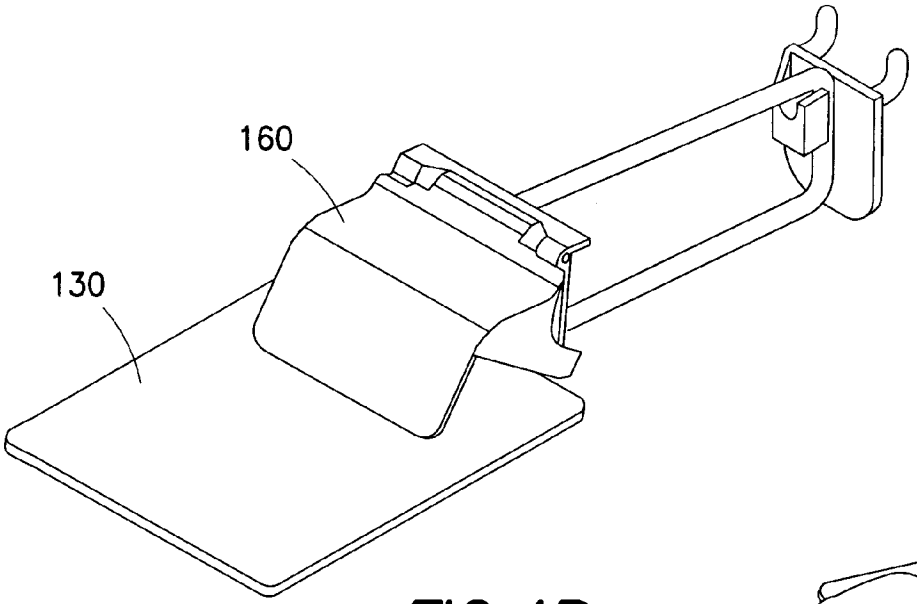
FIG. 4B is a perspective view of the security device and the product display device of FIG. 4A, according to an embodiment of the invention.
Figure 4C:
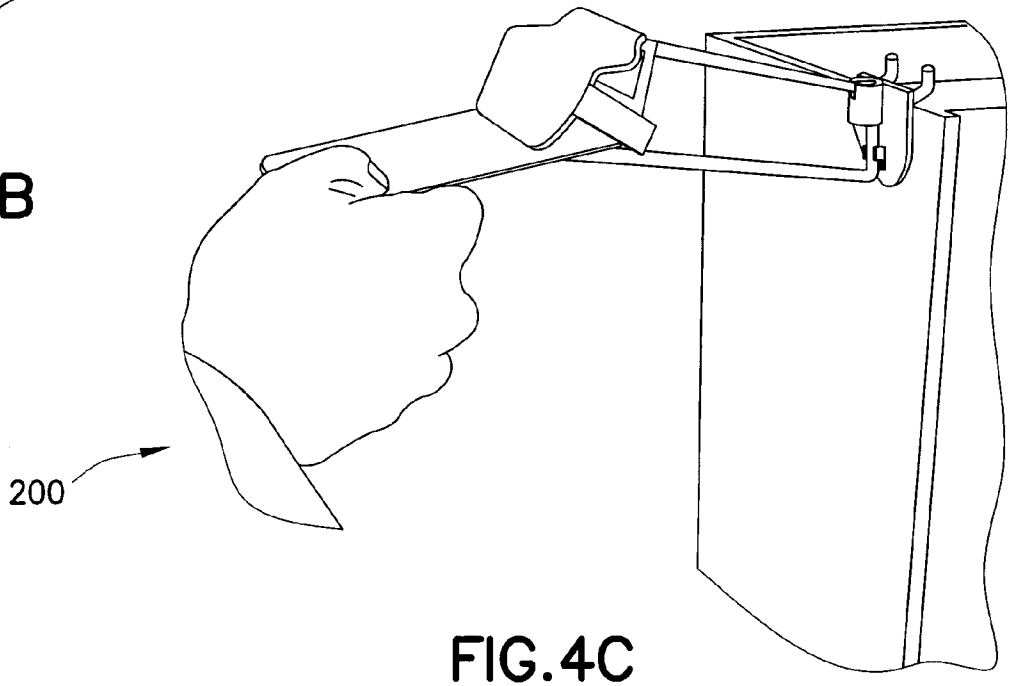
FIG. 4C illustrates the security device and the product display device mounted on the display shelf and in use by a customer locking the product on the peg.

At a predetermined point of the contact, as indicated at points shown generally at C1 and C2, further movement of the portion of the merchandise 130 along the length of the peg hook 114 is inhibited by upturned end 114A (e.g., lengths L1 and L2) with vertical movement is needed as depicted by R2. However, further rotation of the security device 160 is also inhibited by the contact to prevent the vertical movement of the merchandise 130 and acts to capture, trap, lock or otherwise prevent removal of the merchandise 130 from the peg hook 114. For example, as shown in FIG. 4A, one or both of the arm portion 164 and the foot portion 166 of the security device 160 contact, at C2 and C1 respectively, the merchandise 130 and/or product packaging. The contact at one or both of points C1 and C2, and resulting alignment of the merchandise 130 and the security device 160, prevent further rotation of the security device 160 about the axis A and thus, prevents vertical movement needed for passage of the merchandise 130 over the upturned end 114A of the peg hook 114. Accordingly, an inadvertent or unintentional withdrawal or an attempt to "sweep" the merchandise 130 from the peg hook 114, without performing the multi-step process described above, is averted by the security device 160.

As should be appreciated, at least some rotation of the security device 160 and 260 is needed prior to contact with the merchandise 130 and/or its packaging to prevent the aforementioned locking action. The period of time for rotation of the security device, or proximity between the security device 160 and 260 and merchandise 130 being retrieved, that is needed to prevent the contact and locking may be varied by, for example, modifying the form, size and/or angular relation of the security device 160 and 260, and one or more components thereof such as, for example, one or both of the arm portions 164 and 264 and the foot portions 166 and 266 of the respective security devices 160 and 260. In one embodiment, for example, the form, size and/or angular relation of the security device 160 and 260, and/or one or both of the arm portions 164 and 264 and the foot portions 166 and 266, are varied in relation to the form or size of the merchandise 130 or its packaging being secured.

As can be appreciated, the aforementioned locking action is particularly effective when an attempt is made to quickly retrieve a number of items of merchandise from the peg hooks 114 and 214 without operating the security device 160 and 260. For example, shoplifting may be prevented or at least substantially minimized by the fact that both hands need to be used in order to actuate the security device 160 and 260 and remove one or more items of merchandise 130. Most shoplifters attempt to sweep the peg hook 114 with one hand while the other hand shields the shoplifting action with an overcoat held up to block viewing by security cameras or store personnel. Alternatively the shoplifter may use the other hand to hold a bag or backpack which the shoplifter uses to hide the stolen merchandise. The necessity of using both hands to free withdrawal of one or more items of merchandise 130 from the peg hooks 114 and 214 is seen as an effective deterrent to a shoplifter, who typically cannot risk the time and attention drawn by having to use both hands to remove the merchandise.

Figure 6:
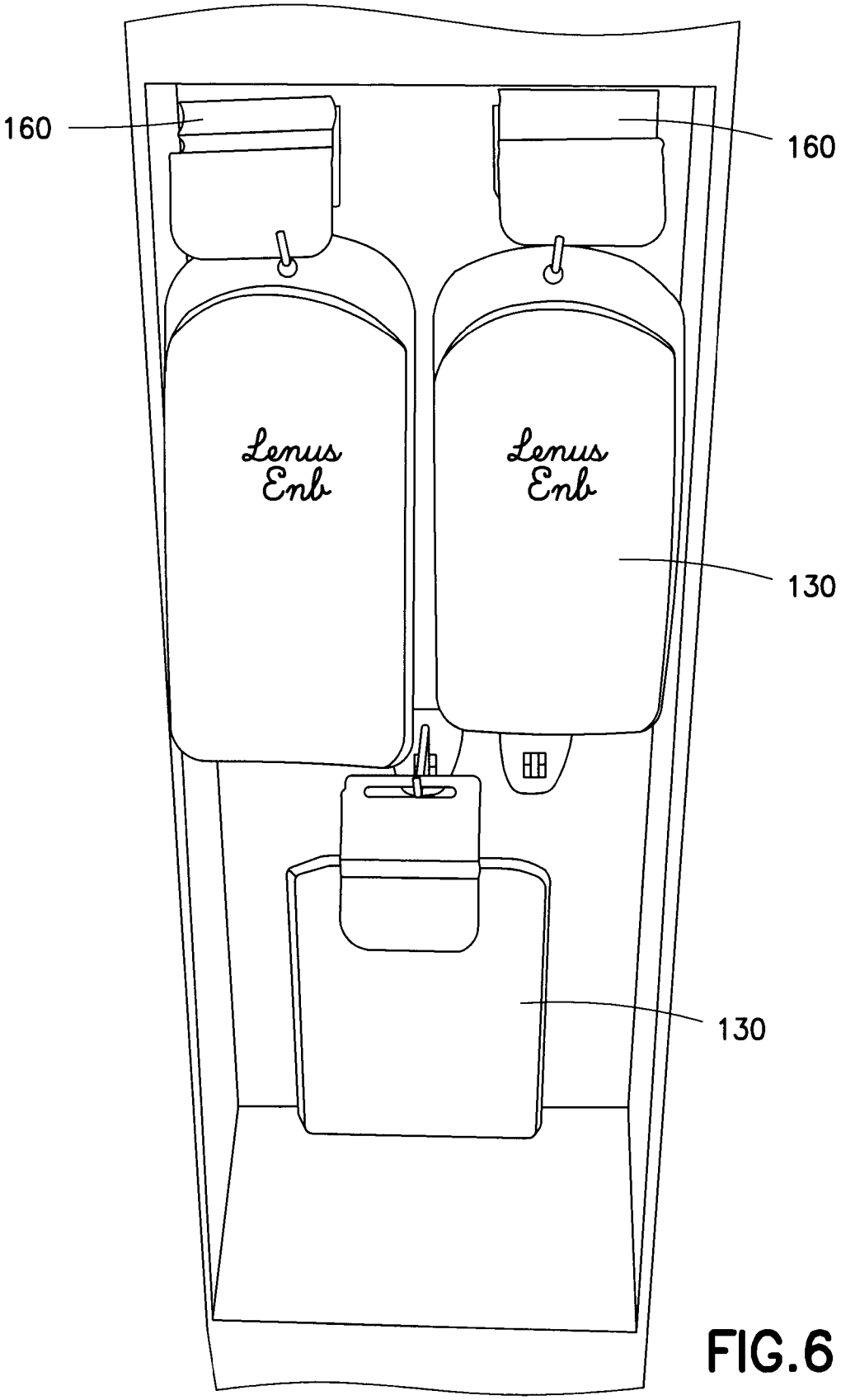
FIGS. 6-11 illustrate operation of the security device and the product display device in accordance with one or more embodiments of the present invention.
Figure 9:
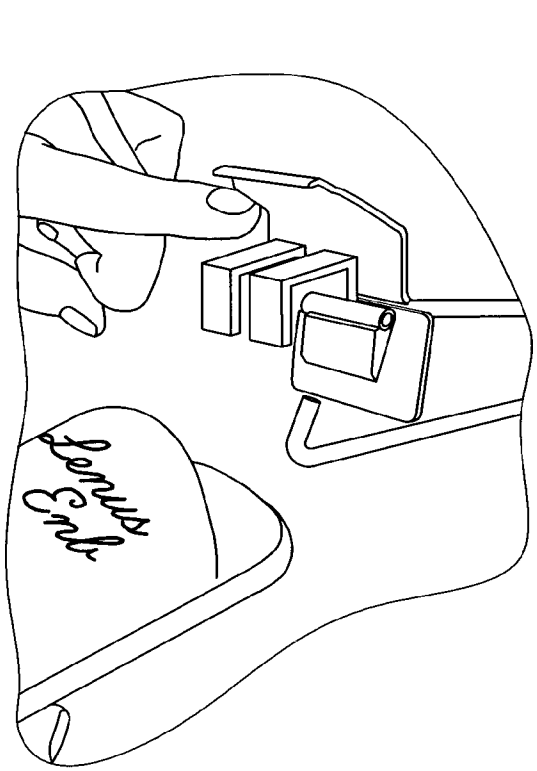
Figure 8:
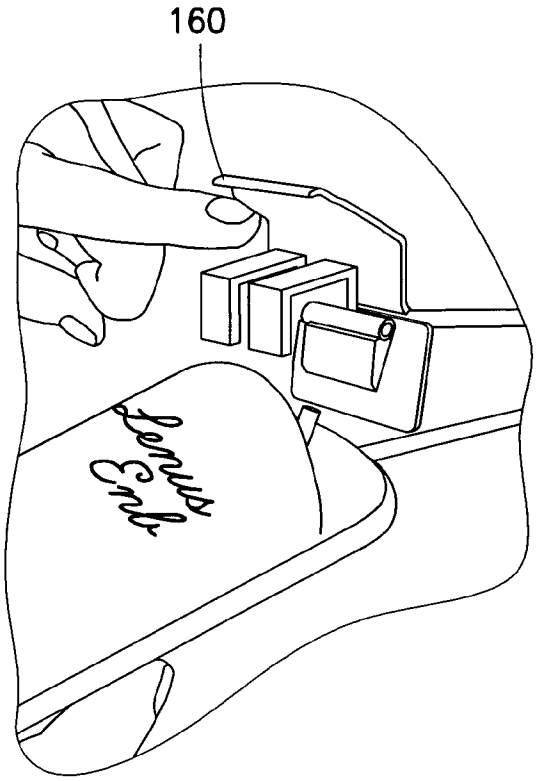
Figure 7:
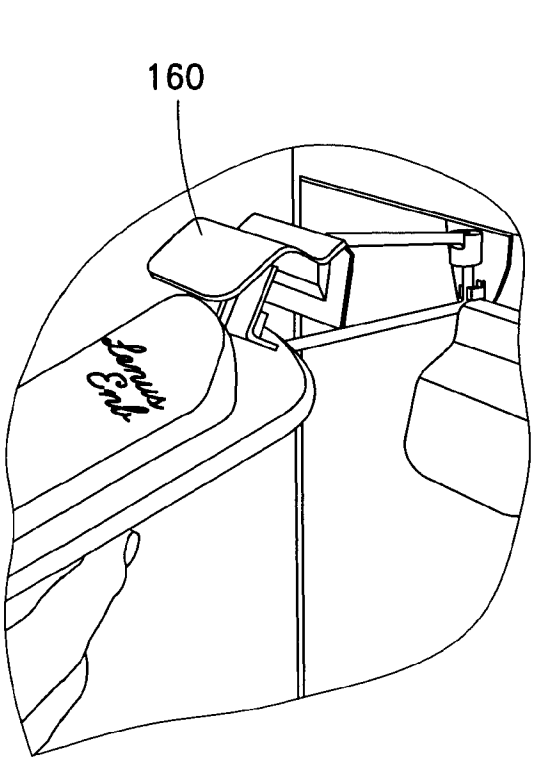
Figure 10:
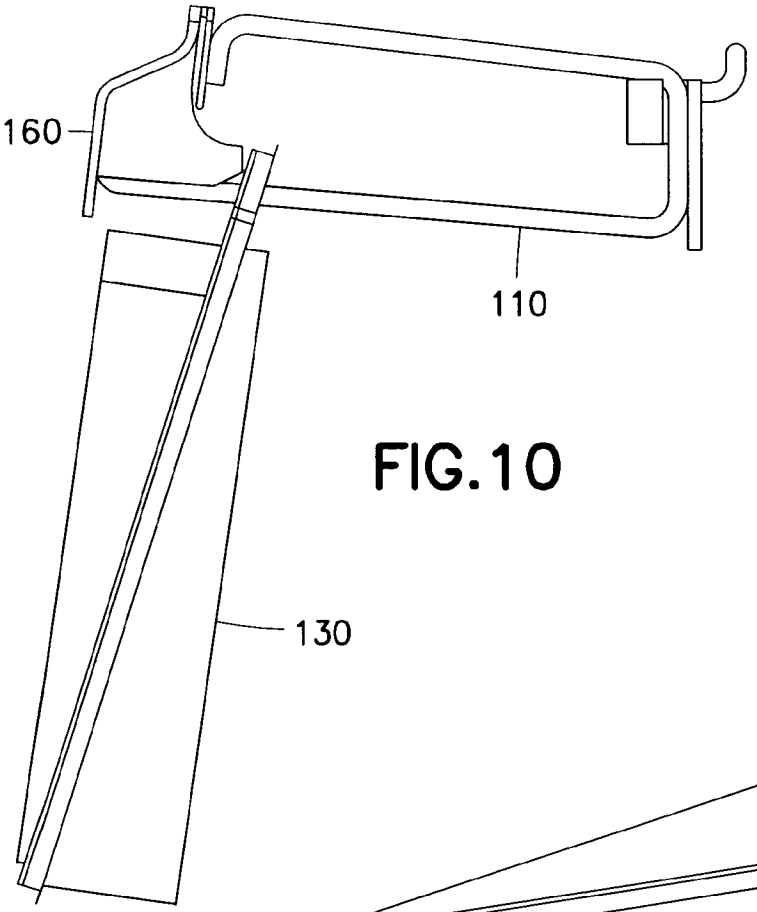
Figure 11:
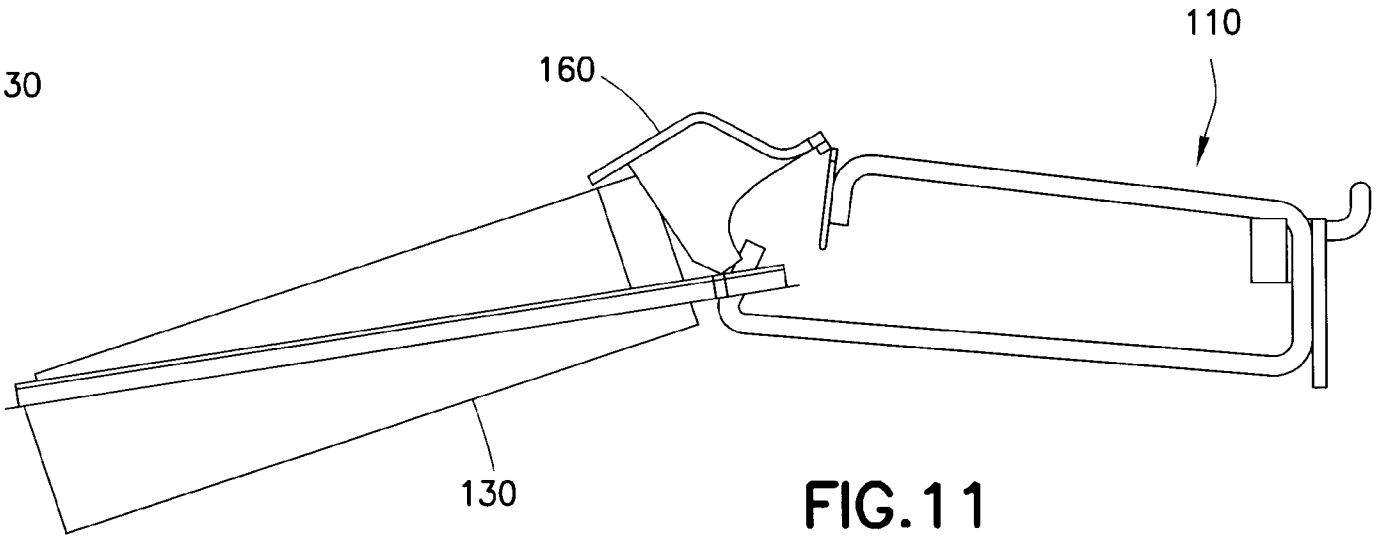

FIGS. 6-11 illustrate one or more security devices 160 and 260 according to one or more embodiments of the present invention coupled to product display devices 110. For example, FIG. 6 depicts a merchandise display featuring a side by side product display devices 110 and security devices 160 exhibiting merchandise, for example, shaving razors and/or components thereof, coupled thereto. FIGS. 7-9 illustrate the customer 200 successfully removing an item of merchandise from the product display device 110 by first actuating the security device 160. FIGS. 10 and 11 depict a theft prevention aspect of the security device 160 by illustrating contact between the merchandise 130 and the security device 160 that effectively prevents the removal of the merchandise 130 from the display device 110 due to the non-rotation of the security device 160. As shown in FIG. 11, the security device 160 traps and locks the merchandise 130 on the end of the peg hook 110 and prevents removal of the merchandise.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure that numerous variations and alterations to the disclosed embodiments will fall within the spirit and scope of the present invention.

What is claimed is:

1. A security device mounted to a product display device having a boom member and a peg hook for exhibiting merchandise, the security device comprising:

a base for mounting the security device to the boom member at a position spaced vertically above the peg hook, the base including a first part having a plurality of apertures and a second part having at least one thread hole for adjustably mounting the first part to the second part to adjust a vertical distance between a lower portion of the base and the peg hook;

an arm portion pivotally mounted to the base for rotation about an axis (A, A');

a foot portion coupled to and extending away from the arm portion;

the security device being disposed in one of a plurality of positions including:

a securing position, where at least a portion of the security device is disposed in front of the peg hook and if the merchandise moves along a length (L1, L2) of the peg hook at least a portion of the merchandise contacts the at least a portion of the security device;

a retrieval position, where the security device is first rotated away from the peg hook and out of the securing position such that when merchandise moves along the length (L1, L2) of the peg hook the merchandise is removable from the peg hook without contacting the security device; and a locking position, where the security device is initially in the securing position and then at least partially rotates away from the peg hook by contact with the merchandise at a predetermined point of contact (C1, C2), the security device inhibits withdrawal of the merchandise from the peg hook.

2. The security device of claim 1, wherein the predetermined point of contact is between the merchandise and the arm portion of the security device, the foot portion of the security device, or a combination thereof.

3. The security device of claim 1, wherein the peg hook comprises an upturned end disposed in proximity to the foot portion of the security device and contact is made by vertical movement of the merchandise moved over the upturned end.

4. The security device of claim 1, wherein the peg hook comprises a raised portion along its length.

5. The security device of claim 2, wherein the foot portion extends perpendicularly away from the arm portion.

6. The security device of claim 1, wherein the foot portion extends perpendicularly away from the arm portion at about a ninety degree (90°) angle.

7. The security device of claim 1, further comprising a placard for displaying information about the merchandise.

8. The security device of claim 7, wherein the placard is attached to a surface of the security device.

* * * * *